US005578548A

United States Patent [19]

Bjork et al.

[11] Patent Number: 5,578,548

[45] Date of Patent: Nov. 26, 1996

[54] THERMOGRAPHIC ELEMENT WITH IMPROVED ANTI-STICK COATING

[75] Inventors: Jon A. Bjork, Cottage Grove; Ramesh C. Kumar, Maplewood; John C. Haidos, St. Paul, all of Minn.

[73] Assignee: Minnesota Mining & Manufacturing Company, St. Paul, Minn.

[21] Appl. No.: 543,410

[22] Filed: Oct. 16, 1995

[51] Int. Cl.[6] ..... B41M 5/26

[52] U.S. Cl. ..... 503/202; 427/152; 503/200; 503/210; 503/226

[58] Field of Search ..... 427/152; 430/338, 430/567, 608, 619; 503/200, 202, 210, 226

[56] References Cited

U.S. PATENT DOCUMENTS 2,910,377 10/1959 Owen ..... 117/36

5,320,914 6/1994 Nakamura et al. ..... 428/694 B 5,416,058 5/1995 Wyttendaele ..... 503/202

*Primary Examiner*—Bruce H. Hess

*Attorney, Agent, or Firm*—Gary L. Griswold; Walter N. Kirn; Gregory A. Evearitt

[57] ABSTRACT

A thermographic element containing: (a) a substrate; (b) an image-forming layer coated onto the substrate; and (c) overlaying the image-forming layer, a topcoat layer composed of the reaction product of (1) a polymer composed of interpolymerized units derived from: (i) about 45–65 wt % of vinyl-substituted aromatic monomer; (ii) about 15–30 wt % vinyl monomer containing a pendant nitrile group; (iii) about 5–30 wt % hydroxyl-containing; ethylenically-unsaturated monomer; and (2) a suitable crosslinking agent. A slip agent is optionally used. The topcoat layer provides a thermographic element with high gloss in the imaged areas; has excellent runnability with no chatter in the feed direction of the element; and exhibits no removal of topcoat which prevents formation of printhead-created voids in the imaged areas.

12 Claims, No Drawings

THERMOGRAPHIC ELEMENT WITH IMPROVED ANTI-STICK COATING

FIELD OF INVENTION

This invention relates to a thermographic element and in particular, it relates to a thermographic element with an improved anti-stick coating.

BACKGROUND

As is widely known in the imaging arts, a thermographic imaging process relies on the use of heat to help produce an image. Typically, a thermally-sensitive image-forming layer is coated on top of a suitable base or substrate material such as paper, plastics, metals, glass, and the like. The resulting thermographic construction is then heated at an elevated temperature, typically in the range of about 60°–225° C., resulting in the formation of an image. Many times, the thermographic construction is brought into contact with the thermal head of a thermographic recording apparatus, such as a thermal printer, thermal facsimile, and the like. In such instances, an anti-stick layer is coated on top of the imaging layer in order to prevent sticking of the thermographic construction to the thermal head of the apparatus utilized.

Thermographic materials whose image-forming layers are based on silver salts of long chain fatty acids, such as silver behenate, are known. At elevated temperatures, silver behenate is reduced by a reducing agent for silver ion such as hydroquinone, substituted hydroquinones, hindered phenols, catechol, pyrogallol, methyl gallate, leuco dyes, and the like, whereby an image is formed.

It is also known that other additives can be added to imaging layers of a thermographic construction to enhance their effectiveness. For example, U.S. Pat. No. 2,910,377 discloses that the silver image for such materials can be improved in color and density by the addition of toners to the imaging layer. Toners which give primarily image density enhancement are also referred to as development accelerators.

Thermographic elements are typically imaged with the use of a thermal printhead whereby heated styli are pressed into intimate contact with the thermographic element or media. When electrically pulsed, the styli are heated which in turn heats the thermographic media which contains two or more components which combine and produce a legible, colored mark. The resulting image is built up in a spotwise manner. To provide good images without voids and with uniform image areas, the surface of the thermal imaging media needs to have good thermal printhead matching characteristics. A good media will have characteristics including maximized slip (i.e., the ease of transport of media underneath the printhead) and minimized "pick-off" (i.e., the removal of topcoat adhering as residue to the printhead which results in image voids).

Conventional thermal printing media or thermographic elements achieve their thermal printhead-matching characteristics typically using high loading of fillers and pigments such as silica, calcium carbonate, clay, and the like. The use of such conventional anti-stick agents in a topcoat on the thermographic element contributes to haze and greatly diminishes the usefulness of the thermographic element for overlaying, projection, or applications where it is used as a mask.

Additionally, during the thermal printing process the pressure and high temperature that the media are exposed to distort the surface of the thermographic element. This thermal marring makes it difficult to achieve high gloss of the resulting images. The high matting effect of higher filler loading gives low gloss media and tends to blend-in low gloss images.

In view of the foregoing, new and improved anti-stick topcoats for thermographic media imaged by thermographic recording apparatus are needed in the industry.

SUMMARY OF THE INVENTION

In accordance with the present invention, it has been discovered that the reaction product of a crosslinking agent and a polymer comprising interpolymerized units derived from: vinyl-substituted aromatic monomer; vinyl monomer containing a pendant nitrile group; and hydroxyl-containing, ethylenically-unsaturated monomer makes an excellent anti-stick topcoat for thermographic elements imaged with a thermal printhead and the like. The above-disclosed crosslinked polymer results in topcoats which provide high gloss of the imaged areas of the thermographic element; have excellent runnability with no chatter in the feed direction of the element; and which exhibit no removal of topcoat by the printhead.

Thus, the present invention provides a thermographic element comprising: (a) a substrate; (b) an image-forming layer coated onto the substrate; and (c) a topcoat overlaying the image-forming layer, the topcoat comprising the reaction product of: (1) a polymer comprising interpolymerized units derived from: (i) about 45–65 wt % vinyl-substituted aromatic monomer; (ii) about 15–30 wt % vinyl monomer containing a pendant nitrile group; (iii) about 5–30 wt % hydroxyl-containing, ethylenically-unsaturated monomer; and (2) a suitable crosslinking agent.

In one preferred embodiment, the topcoat of the inventive thermographic element comprises the reaction product of (1) a polymer comprising interpolymerized units derived from: (i) about 55–60 wt % vinyl-substituted aromatic monomer; (ii) about 20–25 wt % vinyl monomer containing a pendant nitrile group; (iii) about 20–25 wt % hydroxyl-containing, ethylenically-unsaturated monomer; and (2) an isocyanate-functional crosslinking agent.

It is also preferred that a slip agent, such as a siloxane diamine, be present in the topcoat.

As used herein, the phrase "thermographic silver emulsion layer" or "image-forming layer" means a layer comprising a thermally-reducible, light-insensitive silver salt; reducing agent for silver ion; and optionally, development accelerators, toners, etc.

Other aspects, advantages, and benefits of the present invention are apparent from the detailed description, the examples, and claims.

DETAILED DESCRIPTION OF THE INVENTION

In the present invention, the image-forming layer comprises a thermally-reducible source of silver. Thermally-reducible sources of silver are materials, which in the presence of a reducing agent for silver ion, undergo reduction at elevated temperatures, e.g., 60°–225° C. Preferably, these materials are silver salts of long chain carboxylic acids ("fatty acids") containing 10 to 30 and more preferably, 10 to 28 carbon atoms, e.g., silver behenate, silver laurate, etc. The latter are also known in the art as "silver soaps." Complexes of organic or inorganic silver salts wherein the ligand has a gross stability constant between 4.0–10.0 can also be used. Preferably, the silver source material should constitute from about 5–50 percent by weight of the image-forming layer and more preferably, from about 10–30 percent by weight.

The reducing agent for silver ion can be any such reducing agent known to those skilled in the art. Non-limiting examples include phenols, hindered phenols, catechol (1,2-dihydroxybenzene), pyrogallol (1,2,3-trihydroxybenzene), methyl gallate, hydroquinone, substituted-hydroquinones, ascorbic acid, ascorbic acid-derivatives, and leuco dyes. Presently preferred is methyl gallate. The reducing agent is preferably present in the image-forming layer in an amount of from about 5 to about 25 wt % and more preferably, from about 10 to about 20 wt %, based upon the total weight of the image-forming layer.

Non-limiting examples of development accelerators which can be used in the present invention include, but are not limited to, 3-indazolinone compounds; urea; 1,3-diphenyl urea; 1,3-diethyl urea; butyl urea; and ethylene urea.

The use of conventional toners such as phthalazinone, phthalazine, phthalimide, succinimide, barbituric acid, etc., can also be used in the image-forming layer, if desired. When utilized, the toner should preferably be present in the image-forming layer in an amount in the range of 1–6 wt % and more preferably, 2–5 wt %, based upon the total weight of the image-forming layer.

The image-forming layer utilized in the present invention also employs a binder. Any conventional polymeric binder known to those skilled in the art can be utilized. For example, the binder may be selected from any of the well-known natural and synthetic resins such as gelatin, poly(vinyl acetals), cellulose acetate, polyolefins, polyesters, polystyrene, polyacrylonitrile, polycarbonates, and the like. Copolymers and terpolymers are, of course, included in these definitions, examples of which, include but are not limited to, the poly(vinyl acetals), such as poly(vinyl butyral) and poly(vinyl formal), and vinyl copolymers. Preferably, the binder should be present in the image-forming layer in an amount in the range of 15–60 wt %, and more preferably 25–50 wt %, based upon the total weight of the image-forming layer.

Any suitable base or substrate material known to those skilled in the art can be used in the present invention. Such materials can be opaque, translucent, or transparent. Commonly employed base or substrate materials utilized in the thermographic arts include, but are not limited to, paper; opaque or transparent polyester and polycarbonate films; and specularly light reflective metallic substrates such as silver, gold, and aluminum As used herein, the phrase "specularly light reflecting metallic substrates" refers to metallic substrates, which when struck with incident light, reflect the light at a particular angle as opposed to reflecting the light across a range of angles.

The topcoat binder used in the present invention is derived from the reaction of a suitable crosslinking agent with a polymer comprised of interpolymerized units derived from the monomers described below. Non-limiting examples of each type of monomer are as follows:

(a) vinyl-substituted aromatic monomers: styrene, alkylated-styrenes; alkoxy styrenes; vinyl naphthalene; alkylated-vinyl naphthalenes; and alkoxy vinyl naphthalenes;

(b) vinyl monomers containing a pendant nitrile group: acrylonitrile; (meth)acrylonitrile; cyanoethyl-(meth)acrylate; and 2-cyanoethoxyethyl(meth)acrylate; and (c) hydroxyl-containing, ethylenically-unsaturated monomers: hydroxyethylmethacrylate (HEMA); hydroxyethylacrylate (HEA); hydroxypropylmethacrylate (HPMA); and hydroxylpropylacrylate (HPA) and others as disclosed at column 5, lines 17–57, of U.S. Pat. No. 5,320,914, incorporated herein by reference.

The polymer is typically prepared by copolymerizing the reactive monomers in a vessel under an inert atmosphere (such as nitrogen gas) with a free-radical initiator (such as AIBN) and solvent (such as MEK). The resulting polymer may be random or block. Preferably, the polymer will have a weight average molecular weight of from about 10,000 to 300,000 daltons, more preferably from about 20,000 to 75,000 daltons.

The topcoat is prepared by combining the above polymer with an optional slip agent and crosslinking the resultant material with a suitable crosslinking agent. Isocyanate-functional crosslinking agents are presently preferred. Non-limiting examples of isocyanate-functional crosslinking agents include hexamethylene diisocyanate and its derivatives, e.g., biuret of hexamethylene diisocyanate (Desmodur™ N-3000, available from Miles Laboratories, Pittsburgh, Pa.), trimer of hexamethylene diisocyanate (Desmodur™ N-3300, available from Miles Laboratories), etc. Preferably, the crosslinking agent is present in an amount of from about 0.10 to 0.30 wt % and more preferably, from about 0.15 to 0.25 wt %, based upon the total weight of the topcoat.

It is preferred that the topcoat contains a slip agent. Presently preferred slip agents include polysiloxane diamine, and modified and unmodified polydimethylsiloxanes (e.g., BYK-3 10, BYK-321, BYK-333, and BYK-370, all available from BYK-Chemie, USA; Dow Corning Silicone fluids; and GP4, GP5, GP6 available from Genesee Polymers). In the case of slip agents with reactive functional groups (e.g., polysiloxane diamine), it is believed that the slip agent becomes part of the crosslinked network. The slip agent is preferably present in an amount of from about 0.5 to 12 wt %, and more preferably from about 2 to 6 wt %, based on the total weight of the topcoat.

Fillers such as colloidal silica, calcium carbonate, clays, alumina, talc, microcrystalline waxes, and micronized polyethylene may also be added to the topcoat. Small reinforcing filler can be added to the topcoat in amounts of up to 50 wt % of the topcoat coating. Larger, roughening fillers can be added to the topcoat in amounts of from 0.5 to 5 wt % of the topcoat coating.

The topcoat preferably has a coating weight of from about 0.05 to about 0.25 g/ft$^2$ and more preferably, from about 0.1 to about 0.2 g/ft$^2$.

The imaging and anti-stick layers employed in the present invention can be applied by any method known to those skilled in the art such as knife coating, roll coating, dip coating, curtain coating, hopper coating, etc.

The following non-limiting examples further illustrate the present invention.

EXAMPLES

Unless indicated otherwise, all percentages of components or additives referred to herein are in weight percent.

A direct thermal media was prepared by coating a composition comprising a 3:1 ratio of the silver dispersion and the activator solution disclosed below.

| Silver dispersion: | |
|---|---|
| MEK (methyl ethyl ketone) | 72.35 g |
| Toluene | 13.90 g |
| Silver behenate | 7.85 g |
| Poly(vinyl butyral) resin (Acryloid ™ B-76) | 0.34 g |
| Poly(vinyl butyral) resin (Seikisui B-X1) | 3.38 g |
| 30% Colloidal Silica in MEK | 1.94 g |
| Desmodur ™ N-3300 isocyanate | 0.22 g |
| Activator Solution: | |
| Methanol | 39.45 g |
| MEK | 39.45 g |
| Poly(vinyl butyral) (Seikisui B-X1) | 4.05 g |
| Methyl gallate | 10.14 g |
| Tetrachlorophthalic anhydride | 1.70 g |
| Barbituric acid | 0.68 g |
| Succinimide | 3.35 g |

The material was intermixed, coated, and dried to give a dry coating weight of 1.25 g/ft$^2$. On top of this was coated a topcoat (formulations disclosed below) with dry coating weight of 0.15 g/ft$^2$.

Example 1 (Polymer Preparation)

A polymeric reaction product derived from interpolymerized units of styrene/acrylonitrile/hydroxy ethyl methacrylate (weight ratio of 55/19/26) was prepared by charging a 1-liter amber bottle with 137.5 g styrene (ST), 47.5 g acrylonitrile (AN), 65.0 g hydroxyethylmethacrylate (HEMA), 2.5 g mercapto propanediol, 0.75 g 2,2'-azobis(isobutyronitrile) (AIBN), and 375 g of MEK. The resulting mixture was purged with nitrogen at 1 liter per minute for 5 minutes. Afterwards, the bottle was sealed and kept in a constant temperature bath at 65° C. for 60 hrs. The resulting polymer (ST/AN/HEMA) showed 99.2% conversion and had an IV (Intrinsic Viscosity) of 0.23. It was used in the topcoats of Examples 2–4.

Examples 2–4 (Topcoat Formulations)

| Topcoat Component | Example 2 (Inventive) | Example 3 (Comparative) | Example 4 (Comparative) |
|---|---|---|---|
| 5% ST/AN/HEMA Polymer in MEK | 10 g | 0 | 0 |
| 5% Cellulose acetate propionate (Eastman CAP-504-0.2) in MEK | 0 | 10 g | 0 |
| 5% Cellulose Acetate (Eastman 398-6) in MEK | 0 | 0 | 10 g |
| 30% polysiloxane diamine (10,000 MW) in MEK | 0.15 g | 0.15 g | 0.15 g |
| 50% solids Desmodur ™ N-3000 isocyanate in MEK | 0.20 g | 0.20 g | 0.20 g |

All topcoats were coated at 2 mils wet thickness with a knife coater and subsequently dried 3 minutes at 65° C.

All topcoats coated well and had high gloss surfaces. As can be seen from the data below, upon imaging with an Atlantek thermal test bed printer Model 200, crisp, high density images occurred in all instances, but the material of Comparative Examples 3 and 4 had significant thermal marring resulting in lower gloss. The material of Comparative Examples 3 and 4 also had coating removal leading to streaks in the imaged areas after just a few prints. The material of Inventive Example 2 gave the highest gloss of the imaged areas and the best runnability with no chatter in the feed direction and no removal of topcoat, thereby forming no image voids.

| | Example 2 (Inventive) | Example 3 (Comparative) | Example 4 (Comparative) |
|---|---|---|---|
| $D_{min}$ | 0.03 | 0.03 | 0.03 |
| $D_{max}$ | 3.18 | 3.07 | 3.05 |
| UV $D_{min}$ | 0.09 | 0.09 | 0.09 |
| UV $D_{max}$ | 3.99 | 4.09 | 4.05 |
| Haze, % | 8.8 | 7.1 | 5.4 |
| Image Gloss, % | 80.8 | 50.6 | 65.7 |

Examples 5–9 (Inventive Topcoat Formulations)

| Topcoat Component | Example 5 | Example 6 | Example 7 | Example 8 | Example 9 |
|---|---|---|---|---|---|
| 8% Resin in MEK* | 12.50 g | 12.50 g | 12.50 g | 12.50 g | 12.50 g |
| 8% polysiloxane diamine in MEK | 0.50 g | 0.50 g | 0.50 g | 0.50 g | 0.50 g |
| 50% Desmodur ™ N-3300 Isocyanate in MEK | 0.45 g | 0.60 g | 0.78 g | 0.41 g | 0.45 g |
| MEK | 2.36 g | 3.15 g | 4.10 g | 4.72 g | 10.60 g |
| 30% Colloidal Silica in MEK (MEK-ST Nissan Chemical) | | | | | 1.60 g |
| Glycidoxypropyl-trimethoxysilane | | | | | 0.16 g |

*The respective polymeric resins for Examples 5–9 are as follows:
5. ST/AN/HEMA at 65/20/15 weight ratio
6. ST/AN/HEMA at 60/20/20 weight ratio
7. ST/AN/HEMA at 55/19/26 weight ratio
8. ST/AN/HPA at 64/21/15 weight ratio
9. ST/AN/HEMA at 60/20/20 weight ratio All polymeric resins of Examples 5–9 were prepared in a manner similar to the procedure disclosed in Example 1.

The isocyanate is incorporated at a 1:1 stoichiometric amount to the hydroxy acrylate in Examples 5–9.

In Example 9, the colloidal silica is 25% of the dry coating.

These topcoats were coated over thermally-sensitive media and dried to give a dry coating weight of 0.15 g/ft.$^2$ The dry media was then imaged in an Atlantek Thermal Test bed running smooth and quietly, showing no chatter and no "pickoff" in the imaged areas.

| | Ex. 5 | Ex. 6 | Ex. 7 | Ex. 8 | Ex. 9 |
|---|---|---|---|---|---|
| Haze, % | 6.6 | 6.3 | 5.4 | 7.8 | 11.9 |
| Image Gloss, % | 79.8 | 79.6 | 76.8 | 55.0 | 78.6 |

Reasonable variations and modifications are possible from the foregoing disclosure without departing from either the spirit or scope of the present invention as defined by the claims.

What is claimed is:

1. A thermographic element comprising: (a) a substrate; (b) an image-forming layer coated onto said substrate; and (c) overlaying said image-forming layer a topcoat layer comprising: the reaction product of (1) a polymer comprising interpolymerized units derived from: (i) about 45–65 wt % vinyl-substituted aromatic monomer; (ii) about 15–0 wt % vinyl monomer containing a pendant nitrile group; (iii) about 5–30 wt % hydroxyl-containing, ethylenically-unsaturated monomer; and (2) a crosslinking agent.

2. The thermographic element according to claim 1 wherein said image-forming layer comprises thermally reducible, light-insensitive silver salt and reducing agent for silver ion.

3. The thermographic element according to claim 2 wherein said image-forming layer further comprises toner.

4. The thermographic element according to claim 1 wherein said topcoat layer comprises the reaction product of (1) a polymer comprising interpolymerized units derived from: (i) about 55–60 wt % vinyl-substituted aromatic monomer; (ii) about 20–25 wt % vinyl monomer containing a pendant nitrile group; (iii) about 20–25 wt % hydroxyl-containing, ethylenically-unsaturated monomer; and (2) an isocyanate-functional crosslinking agent.

5. The thermographic element according to claim 1 wherein said vinyl-substituted aromatic monomer is selected from the group consisting of: styrene, alkylated-styrenes; alkoxy styrenes; vinyl naphthalene; alkylated-vinyl naphthalene, and alkoxy vinyl naphthalenes.

6. The thermographic element according to claim 1 wherein said vinyl monomer containing a pendant nitrile group is selected from the group consisting of: acrylonitrile; (meth)acrylonitrile; cyanoethyl-(meth)acrylate; and 2-cyanoethoxyethyl-(meth)acrylate.

7. The thermographic element according to claim 1 wherein said hydroxyl-containing, ethylenically-unsaturated monomer is selected from the group consisting of: hydroxyethylmethacrylate; hydroxyethylacrylate; hydroxypropylmethacrylate; and hydroxypropylacrylate.

8. The thermographic element according to claim 1 wherein said crosslinking agent is an isocyanate-functional crosslinking agent.

9. The thermographic element according to claim 8 wherein said topcoat further comprises a slip agent.

10. The thermographic element according to claim 9 wherein said slip agent comprises siloxane diamine or polydimethylsiloxane.

11. The thermographic element according to claim 9 wherein said topcoat further comprises a filler.

12. The thermographic element according to claim 1 wherein said crosslinking agent is a diisocyanate.

* * * * *